United States Patent [19]

Ferraro

[11] 4,272,885

[45] Jun. 16, 1981

[54] SHAVING CARTRIDGE

[75] Inventor: Frank A. Ferraro, Trumbull, Conn.

[73] Assignee: Warner-Lambert Company, Morris Plains, N.J.

[21] Appl. No.: 3,825

[22] Filed: Jan. 16, 1979

Related U.S. Application Data

[63] Continuation-in-part of Ser. No. 831,469, Sep. 8, 1977, abandoned.

[51] Int. Cl.[3] ..... B26B 21/06; B26B 21/22

[52] U.S. Cl. ..... 30/47; 30/50

[58] Field of Search ..... 30/47, 50, 77, 81, 82, 30/346.58

[56] References Cited

U.S. PATENT DOCUMENTS

| | | | |
|---|---|---|---|
| 1,633,139 | 6/1927 | Staats-Oels | 30/50 |
| 1,934,422 | 11/1933 | Gray | 30/50 |
| 2,070,028 | 2/1937 | Samuel | 30/77 |
| 2,085,423 | 6/1937 | Glazier | 30/77 |
| 2,807,084 | 4/1957 | Harman | 30/50 |
| 3,722,090 | 3/1973 | Dawidowicz | 30/81 X |
| 3,783,510 | 1/1974 | Dawidowicz | 30/50 X |

*Primary Examiner*—Gary L. Smith

*Attorney, Agent, or Firm*—Jeremiah J. Duggan; Louis S. Gillow

[57] ABSTRACT

A razor cartridge including a blade seat, a seat blade, a cap blade, a cap and a spacer between the blade wherein cutting edges of the blades are exposed for shaving. The spacer is provided with a series of projections, at least some of which extend beyond cutting edges of the blades for diminishing contact between the blades and the skin to reduce potential for scraping and produce improved comfort in shaving. Preferably, various spacer projections of the series extend forwardly differing amounts to compensate for differing skin deformations along the length of the razor blades.

12 Claims, 5 Drawing Figures

SHAVING CARTRIDGE

CROSS-REFERENCE TO RELATED APPLICATION

This application is a continuation-in-part of U.S. Application Ser. No. 831,469 filed Sept. 8, 1977, by Frank A. Ferraro for SHAVING CARTRIDGE, now abandoned.

BACKGROUND OF THE INVENTION

1. Field of the Invention

Shaving equipment with particular reference to improvements in double-bladed disposable razor cartridges.

2. Description of the Prior Art

A prior art shaving instrument includes a system using two blades. This system comprises a plastic blade seat having a guard bar, a seat blade, a blade spacer, a cap blade and a plastic cap, assembly of which provides a disposable shaving cartridge.

The cartridge may be provided with a channel or similar attachment means into which a reusable razor main frame is loaded to complete the shaving instrument. Spent cartridges are removed from the main frame and replaced by new units.

These double-bladed cartridges produce hair-cutting action along substantially the full lengths of the exposed shaving edges of the two blades and any irritation experienced as a result of the hair-cutting forces and skin contact is, of course, deemed undesirable. Compromises can be made with respect to shave angles and exposure, span of the blades, the gap therebetween and/or the configuration of the guard bar to alter shaving performance. The latter, however, can only reduce skin contact with the seat blade edge but not with that of the cap blade.

It is an object of this invention to reduce skin contact with the shaving edge while effectiveness in shaving is preserved.

It is also an object of the invention to accomplish the foregoing with minimal alteration of long-standing cartridge design, minimal expenditure and compatability with conventional reusable razor main frames.

Other objects and advantages of the invention will become apparent from the following description of the invention.

SUMMARY OF THE INVENTION

The aforesaid objects and their corollaries are accomplished by the provision of an improved double-edge razor cartridge, the system of which includes, in order: a blade seat, a seat blade, a spacer, a cap blade and a cap. In conventional fashion, the cap and blade seat are preferably constructed of a molded plastic material, the latter having formed thereon a loading channel into which a reusable razor main frame may be inserted for loading of the cartridge.

With the aim of reducing razor blade edge contact against the skin while lending unusual shaving comfort without sacrifice of shaving closeness, the spacer is provided with a series of projections, at least some of which extend beyond a plane tangent to the cutting edges of the two blades. This produces an effective decrease in blade exposure, reducing irritation and generating greater than usual shaving comfort and safety. The spacer projections are terminally smoothly surfaced to afford optimum gliding over portions of the skin engaged thereby. Blade exposure is defined as the normal distance (above (+) and below (−)) between the edge and a plane tangent to the next surface forward and rearward of the cutting edge.

Further, in one embodiment, the margin defined by the forward extremities of the series of spacer projections is other than parallel to the blade edges to compensate for differing skin deformations along the length of the razor blades.

Details of the invention will be more readily understood by reference to the following description when taken in conjunction with the accompanying drawings.

DESCRIPTION OF THE PREFERRED EMBODIMENTS

Figure 1:
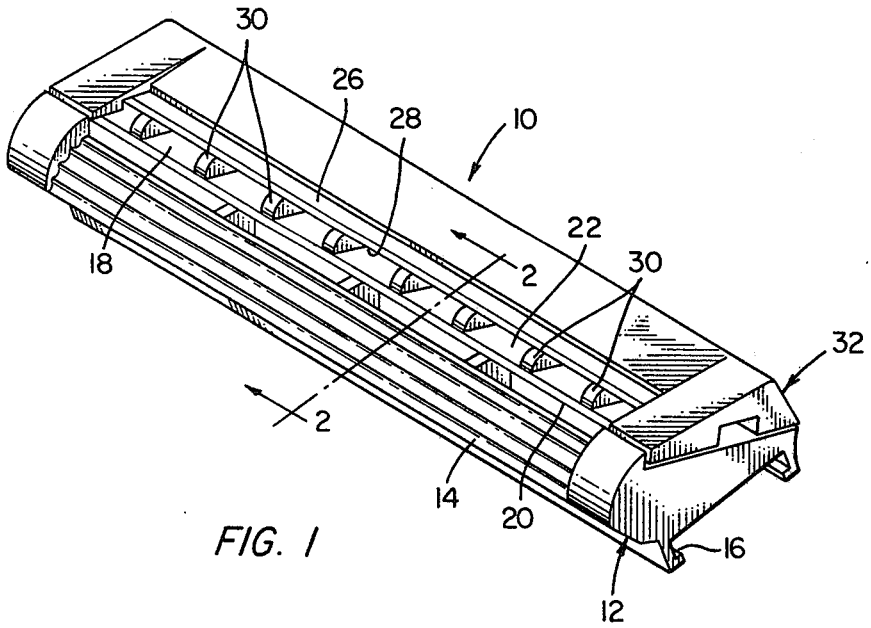
FIG. 1 is an illustration, in perspective, of a razor cartridge embodying an aspect of the invention.
Figure 2:
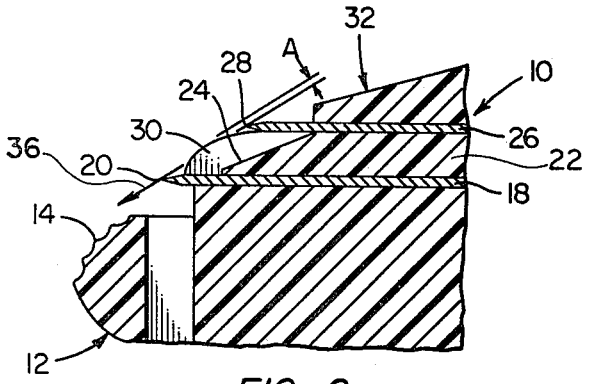
FIG. 2 is a fragmentary cross-sectional view of the cartridge illustrated in FIG. 1.

Referring more particularly to FIGS. 1 and 2 of the drawings, it will be seen that razor cartridge 10 comprises a blade seat 12 having formed thereon a guard bar 14 and channel 16, the latter being used to load cartridge 10 upon a conventional reusable razor main frame in the customary manner of sliding a receiving portion of the main frame into channel 16 or sliding channel 16 over the receiving portion of the razor main frame.

Resting upon blade seat 12 is seat blade 18 having its shaving edge 20 exposed immediately above guard bar 14. Next in the order of the assembly, i.e., from blade seat 12 upwardly as illustrated in FIGS. 1 and 2, is spacer 22 having forward margin 24 upon which cap blade 26 is positioned with its shaving edge 28 exposed. Forwardly rounded projections 30 along margin 24 of spacer 22 extend outwardly beyond shaving edge 28 of blade 26 for interrupting the area of potential contact between shaving edge and the skin during a shaving operation as will be described in detail shortly. In this embodiment, projections 30 may extend (dimension A of FIG. 2) between 0.012 and 0.00 inch and in a preferred embodiment 0.006 inch above the plane tangent to the blade edges. In the same preferred embodiment, end projection is approximately 0.010 inch in width and eight are deployed equidistant along the margin 24 of spacer 22. Of course, these dimensions may be substantially varied to attain desired results without departing from the invention.

Cap 32 is secured to blade seat 12 and completes the assembly of cartridge 10. Blade seat 12 and cap 32 are preferably, but not necessarily, formed of a rigid molded plastic material. Spacer 22 may also be formed of a molded plastic material or a corrosion-resistant metal. Blades 18 and 26 are of conventional design and formed of the usual heat-treated blade steel.

Figure 3:
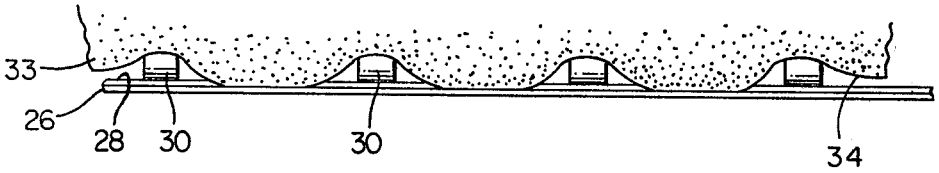
FIG. 3 is a diagrammatic illustration of blade edge contact with the skin during shaving according to the invention.

In FIG. 3 there is diagrammatically illustrated a cross-section of skin 33, the surface 34 of which is illustrated as being in close proximity with edges 20 and 28 of blades 18 and 26, particularly along the center of the blades, in the course of a shaving operation.

Considering FIG. 3 as being a fragmentary view of edge 28 of blade 26 as it appears when looking in the direction of arrow 36 (FIG. 2), it can be seen that potential contact of edge 28 with surface 34 of skin 33 is decreased by projections 30 of spacer 22. Skin 33 is similarly interruptedly removed from possible engagement with edge 20 of blade 18, which edge 20 is immediately beyond spacer 22 in the FIG. 3 illustration and, accordingly, not visible.

Figure 4:
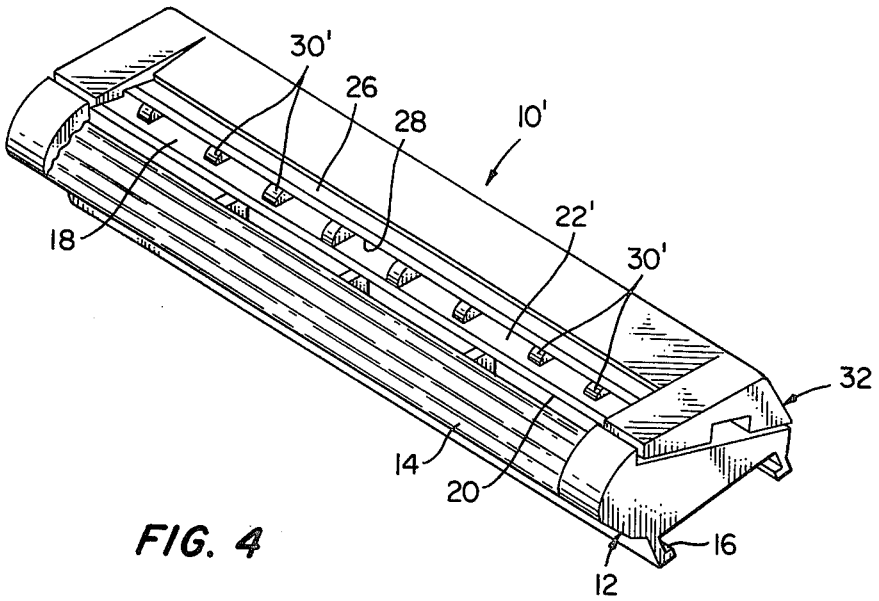
FIG. 4 is an illustration, in perspective, of a razor cartridge embodying a further aspect of the invention.
Figure 5:
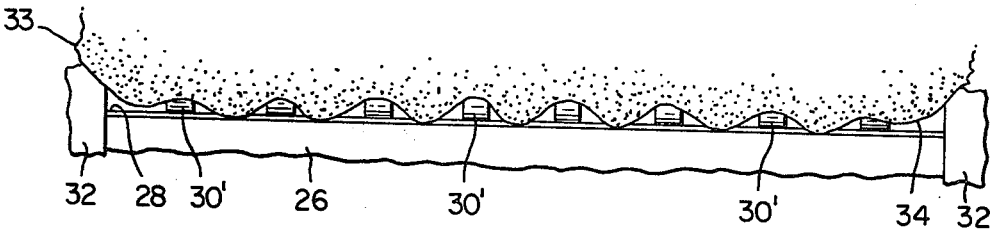
FIG. 5 is a diagrammatic illustration of blade edge contact with the skin during shaving according to the FIG. 4 embodiment of the invention.

In accordance with another embodiment of the invention, as illustrated in FIGS. 4 and 5, a cartridge 10′ is similar in most respects to cartridge 10 described above, except that the projections 30′ of spacer 22′ extending forwardly from margin 24′ are of differing lengths such that they extend differing distances above the plane tangent to the blades. Specifically, those projections 30′ near the center of cartridge 10′ are longer than those at opposite ends. Preferably, projections 30′ change length from maximum to minimum in a continuous and similar manner as one moves from the cartridge center to either side. In a preferred embodiment, projections 30′ near the center of cartridge 10′ extend 0.006 inch above the plane tangent to the blade edges, with the projections proximate the side of the cartridge being substantially flush (0.000) with the plane. However, the center-most projections 30′ may extend between 0.000 and 0.012 inch beyond the plane tangent to the blade edges with the projections at the lateral extremes extending between −0.006 and +0.006 inch respectively from the plane.

This contouring of the margin formed by the forward ends of the several projections 30′ arrayed across cartridge 10′ is done to effect a more uniform presentation of skin surface 34 to the blades, and particularly cap blade 26. The structure of most cartridges 10′ is such that skin 33 may relatively bulge or protrude toward the blades most near the center of the cartridge and less toward the lateral extremes thereof. This may result because most razor handles are positioned centrally of a cartridge and may concentrate forces there, and more likely because of skin-supporting surfaces on cartridge 10′ formed at the lateral extremes of the cap 32 and guard 14. For this reason, the skin near the opposite ends of the blades may not be close enough to the blade edges when using the FIG. 1 embodiment to afford suitable shaving qualities thereat. Accordingly, the embodiment of FIGS. 4 and 5 provides greatest support for skin surface 34 in the mid-region of cartridge 10′ and lesser support toward the lateral extremes, thereby effecting a more uniform distribution of the shaving forces between blades and skin (whiskers) across the length of the blades. Stated another way, projections 30′ are shortest near the blade ends to allow the skin in contact therewith a closer approach to the blades in that region than might be possible if all projections were of equal length.

In contrast to the usual continuous line proximity of a shaver's skin along each exposed edge of a razor cartridge blade, the interruption by projections 30 according to the present invention and as diagrammatically illustrated in FIGS. 3 and 5 affords an effective decrease in blade exposure to the shaver with a substantial reduction in irritation from scraping and cutting of the skin surface by the edges. The reduction in razor drag and lessening of skin contact enhances shaving comfort. Projections 30 are smoothly surfaced so as to optimally glide over portions of the skin which they engage. In prior art tandem blade cartridges, the skin convexly flexes into the space between the first and second blades about an axis parallel to the edges. In the preferred embodiments, projections 30 now appear to cause the skin to protrude into the region in a substantially cross-axis mode, i.e., convexly about an axis normal to the edge thereby reducing the effective exposure of the cap blade. A similar but reduced effect is apparently produced with respect to seat blade 18.

Those skilled in the art will readily appreciate that there are various modifications and adaptations of the precise form of the invention here shown which may suit particular requirements. For example, more or less projections 30 along serrated edge 24 of spacer 22 than have been shown may be incorporated. These projections may be variously smoothly shaped, i.e., proportionally of larger or smaller size than illustrated and/or differently uniformly or irregularly spaced along edges 20 and 28 of blades 18 and 26. Accordingly, the foregoing illustration of the invention is not to be interpreted as restrictive beyond the extent necessitated by the following claims.

What is claimed is:

1. A razor cartridge comprising:
   - a blade seat;
   - a seat blade having a cutting edge exposed for shaving;
   - a cap blade having a cutting edge extending rearwardly of and substantially parallel with said edge of said seat blade and exposed for shaving;
   - a cap; and
   - a spacer between said blades, said spacer having a forward margin disposed behind and in substantially parallel relationship with said cutting edge of said seat blade, said margin of said spacer including projections extending forwardly of said cap blade cutting edge for decreasing contact between said blade edges and the skin to reduce irritation in shaving with said cartridge, at least one of the projections having a forward extent greater than that of another of the projections and extending at least to a plane tangent to both cutting edges.

2. A razor cartridge according to claim 1 wherein said cap and blade seat are formed of a molded plastic material and said blade seat includes a guard bar forward of said seat blade edge, said blade seat further including channel means for adapting said cartridge to a razor main frame.

3. A razor cartridge according to claim 2 wherein said spacer is formed of metal.

4. A razor cartridge according to claim 2 wherein said spacer is formed of a plastic material.

5. A razor cartridge according to claim 1 wherein said projections are of generally arcuate slope and having a smooth surface to afford optimum gliding over portions of skin engaged thereby.

6. A razor cartridge according to claim 1 wherein each projection has a width of approximately 0.010 inch.

7. A razor cartridge according to claim 6 wherein approximately eight projections are deployed equidistant across said spacer forward margin.

8. A razor cartridge according to claim 1 wherein said spacer includes a number of the projections arrayed from near one end to near the other end of a said blade and at least one of the projections nearest the middle of a said blade extends forward to the relatively greatest extent.

9. A razor cartridge according to claim 8 and wherein the projections nearest the opposite ends of the said blades extend forward to the relatively least extent.

10. A razor cartridge according to claim 9 wherein each projection to each side of the middle of said blade extends forward to a successively lesser extent than the previous projection in moving from the center of the blade toward either of its ends.

11. A razor cartridge according to claim 10 wherein the projections extend between approximately 0.000 inch and 0.012 inch above the plane near the center of a said blade and between approximately +0.006 inch and −0.006 inch respectively above the plane near the ends of a said blade.

12. A razor cartridge according to claim 11 wherein at least one of the projections nearest the center of a said blade extends approximately 0.006 inch above the plane and the projections nearest the ends of the blade extend approximately to the plane.

* * * * *